US005519194A

United States Patent [19]

Gong

[11] Patent Number: 5,519,194

[45] Date of Patent: May 21, 1996

[54] AUTOMATIC THAWING APPARATUS FOR A MICROWAVE OVEN

[75] Inventor: Chun S. Gong, Kyungsangnam-Do, Rep. of Korea

[73] Assignee: Goldstar Co., Ltd., Seoul, Rep. of Korea

[21] Appl. No.: 363,018

[22] Filed: Dec. 23, 1994

[30] Foreign Application Priority Data

Dec. 30, 1993 [KR] Rep. of Korea ..... 31394/1993

[51] Int. Cl.[6] ..... H05B 6/68

[52] U.S. Cl. ..... 219/703; 219/710; 219/494; 99/325

[58] Field of Search ..... 219/703, 702, 219/704, 715, 716, 709, 710, 494; 99/325

[56] References Cited

U.S. PATENT DOCUMENTS

| | | | |
|---|---|---|---|
| 4,210,795 | 7/1980 | Lentz | 219/709 |
| 4,335,293 | 6/1982 | Kobayashi et al. | 219/707 |
| 4,420,668 | 12/1983 | Larson et al. | 219/709 |
| 4,430,540 | 2/1984 | Scalf | 219/720 |
| 4,484,050 | 11/1984 | Horinouchi et al. | 219/710 |
| 4,599,503 | 7/1986 | Ueda . | |
| 4,841,111 | 6/1989 | Kokkeler et al. . | |
| 4,952,766 | 8/1990 | McDonald | 219/706 |
| 5,237,141 | 8/1993 | Yoshino et al. | 219/709 |

FOREIGN PATENT DOCUMENTS

| | | |
|---|---|---|
| 0031156 | 1/1981 | European Pat. Off. . |
| 2081476 | 2/1982 | United Kingdom . |
| 2184834 | 7/1987 | United Kingdom . |
| 2212299 | 7/1989 | United Kingdom . |

*Primary Examiner*—Philip Leung

[57] ABSTRACT

An improved automatic thawing apparatus for a microwave oven capable of advantageously thawing food which includes a heating chamber for a food placement therein; a microwave generator for providing microwave energy into the heating chamber in order to heat the food therein; at least one amplifier for amplifying signals detected by a thawing state detection circuit to a predetermined level; a bias voltage control circuit for generating bias signals for initializing an output signal of the amplifier to a predetermined level in beginning of the thawing operation; and a control circuit for controlling the initialization of the output signal of the amplifier to the predetermined level by controlling the bias voltage control circuit, for judging the thawing state of the food in the heating chamber in response to the signal outputted from the amplifier, and for outputting control signals to the microwave generator in accordance with such judgement.

12 Claims, 4 Drawing Sheets

AUTOMATIC THAWING APPARATUS FOR A MICROWAVE OVEN

BACKGROUND OF THE INVENTION

1. Field of the Invention

The present invention relates to an automatic thawing i,e., "defrosting," apparatus for a microwave oven, and particularly to an improved automatic thawing apparatus of a microwave oven capable of advantageously thawing a food therein by amplifying thawing state detection signals to a predetermined level using at least one amplifier and by judging food thawing state using the amplified signals.

2. Description of the Conventional Art

Referring to FIG. 1, a conventional automatic thawing apparatus of a microwave oven includes a power supply circuit 1 in order to supply power to the elements thereof requiring, a key input circuit 2 for selecting a desired function using control keys, a display circuit 3 for displaying the operation states in response to key selections from the key input circuit 2, a thawing state detection circuit 4 for detecting a thawing state of the food using a sensor 6, and a microcomputer 5 for controlling the thawing operation in response to the signals inputted from the key input circuit 2 and the thawing state detection circuit 4.

The detailed operation of the conventional automatic thawing apparatus of the microwave oven will now be explained.

To begin with, power is applied to the corresponding elements thereof by the power supply circuit 1, and a user selects a desired function via the key input circuit 2. Thereafter, the microcomputer 5 performs a predetermined operation in response to the key signals inputted from the key input circuit 2. At this time, if the key signals inputted from the key input circuit 2 are for thawing the food, the microcomputer 5 judges the food thawing state by receiving the signals detected by the thawing state detection circuit 4. Here, the thawing state detection circuit 4 includes a variable resistance Rs of the sensor 6, one end of which is connected to the power supply voltage Vcc and a fixed resistance Rf, one end of which is connected to ground. Here, the variable resistance Rs and the fixed resistance Rf are directly connected in series. Since the resistance value of the variable resistance Rs varies in accordance with the thawing state of the food, the power supply voltage VCC is divided at the output terminal connected between the variable resistance Rs and the fixed resistance Rf. Thereafter, the capacitor C which is connected to ground and in parallel with the fixed resistance outputs the divided voltage to the microcomputer 5, where the divided voltage represents the thawing state detection signal for indicating the thawing state of the food.

The microcomputer 5 judges the thawing state of the food in accordance with the signal outputted from the thawing state detection circuit 4. In accordance with such judgement, the output of the microwaves and the thawing time are controlled and then the food is properly thawed thereby. In addition, the display circuit 3 displays the operation mode and the thawing time.

However, referring to FIG. 2, the signal level difference between the signal which the thawing state detection circuit 4 outputs to the microcomputer at the initial state of the food thawing operation and the corresponding signal at a finishing time of the thawing operation is small. Therefore, the correct thawing state might not be obtained due to external noises in the thawing state detection signal, so that the output of the microwave energy or the thawing time are not advantageously controlled.

SUMMARY OF THE INVENTION

Accordingly, it is an object of the present invention to provide an automatic thawing apparatus for a microwave oven. It is another object of the present invention to provide an improved automatic thawing apparatus for a microwave oven capable of advantageously thawing food therein by amplifying a thawing state detection signal to a predetermined level using at least one amplifier and by judging a food thawing state using the amplified signal.

To achieve the objects of the present invention, there is provided an automatic thawing apparatus for a microwave oven which includes a heating chamber for a food placement therein; a microwave generating means for providing high frequency microwave energy to the heating chamber in order to heat food therein in accordance with control signals applied thereto; at least one amplifier for amplifying a thawing state detection signal detected by a thawing state detection circuit to a first predetermined level; a bias voltage control circuit for generating bias signals for biasing an output signal of the amplifier to a predetermined level at the beginning of a thawing operation; and a control means controlling the bias voltage control circuit for initializing output signals of the amplifier to said predetermined level, for judging a thawing state of the food in the heating chamber in accordance with the thawing state detection signal outputted from the amplifier, and for outputting the control signals in accordance with a result of such judgement.

DETAILED DESCRIPTION OF THE INVENTION

Figure 3:
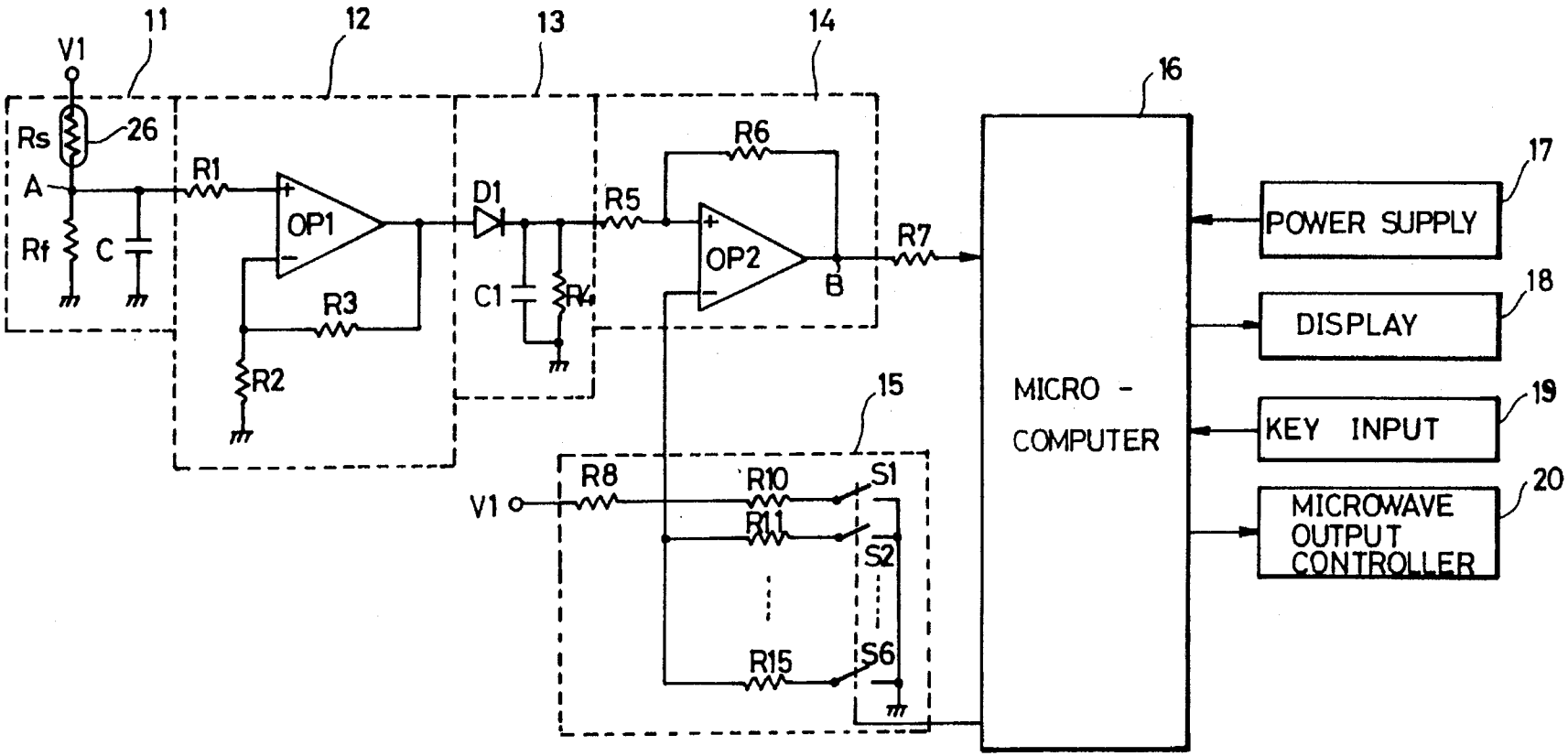
FIG. 3 is a block diagram showing a structure of an automatic thawing apparatus for a microwave oven according to the present invention.

Referring to FIG. 3, an automatic thawing apparatus for a microwave oven of the present invention includes a thawing state detection circuit 11 for detecting a food thawing state, a first amplifier 12 for amplifying a thawing state detection signal detected by the thawing state detection circuit 11 to a first predetermined level in accordance with the values of the resistances R2 and R3, a rectifier 13 for rectifying the signal amplified by the first amplifier 12 into a direct current voltage, a second amplifier 14 for amplifying the output signal of the rectifier 13 to a second predetermined level in accordance with the values of the resistances R5 and R6, a bias voltage control circuit 15 for initializing the level of the signal output detected by the second amplifier 14, a microcomputer 16 for judging the thawing state of the food 25 by analyzing the signal outputted from the second amplifier 14 and for controlling the thawing operation by controlling the output of the high frequency energy and the thawing time and the like in accordance with such judgement, a power supply circuit 17 for supplying power to elements requiring the same, a display circuit 18 for displaying the operation states of the thawing time and the microwave oven, a key input circuit 19 for selecting the desired functions, and a microwave output control circuit 20 for controlling the output of the high frequency microwave energy in accordance with the control signals from the microcomputer 16.

Figure 5:
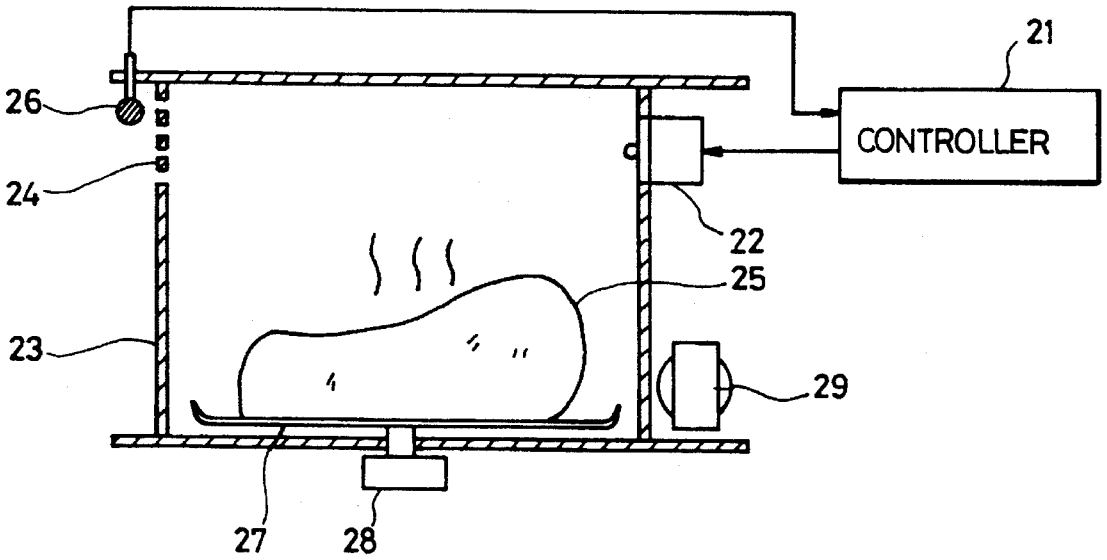
FIG. 5 is a view showing a microwave oven equipped with an automatic thawing apparatus according to the present invention.

Referring to FIG. 5, the microwave oven with the thawing apparatus according to the present invention applied thereto includes a controller 21 including every part of the automatic thawing apparatus of FIG. 3 except the sensor 26, a heating chamber 23 for the food 25 to be cooked therein, a turntable motor 28 for rotating a turntable 27 having the food 25 placed thereon, a magnetron 22 for supplying high frequency microwave energy to the heating chamber 23 in accordance with the control signals of the controller 21, an exhausting port 24 for exhausting gas and moisture which are generated at the heating chamber 23 to the outside, the detection circuit 11 including the sensor 26 for detecting the condition of the gas and moisture which are generated due to the food thawing and for providing a sensor signal to the controller 21, and a high voltage transformer 29 for generating a high voltage.

The detailed operation and effects of the present invention will now be explained with reference to FIGS. 3 to 6.

When the power supply circuit 17 supplies power to all elements of the microwave oven including the microcomputer 16, the microwave oven becomes activated. At this time, if the automatic thawing mode is selected by a user via the key input circuit 19, the microcomputer 16 initialize the voltage at point B of the output of the second amplifier 14 to be within a range of $0^{18}0.5$ V by controlling the bias voltage control circuit 15. Here, the reason for initializing the voltage of the thawing state detection signal at point B applied to the microcomputer 16 is to secure a more correct judgement of the thawing state of the food 25 by the microcomputer 16 since the signal voltage at point B is not usually stable.

A more detailed operation of the bias voltage control circuit 15 will be now explained.

Generally, at an initial stage of the thawing operation, 1~2 volts is usually applied at the non-inverting input terminal of an operational amplifier OP2. In order to set the signal voltage at point B to be within a range of 0~0.5 V, a bias or offset of an appropriate value should be supplied to the inverting input of the operational operation OP2. The bias voltage control circuit 15 includes resistances R10 to R15, one end of each of which resistances R10 to R15 is commonly connected to the resistance R8 and the other ends of each of the resistances R10 to R15 are respectively connected to one end of the switches S1 to S6. Here, the other ends of the switches S1 to S6 are commonly connected with each other and to ground. In addition, the supply voltage V1 is supplied to the other end of the resistance R8. The switches S1 to S6 are selectively turned on or off(closed or opened) in response to a switching control signal from the microcomputer 16.

When the microcomputer 16 detects the thawing state detection voltage at point B through the resistance R7 at an initial stage of the thawing operation and outputs the corresponding switching control signals to the switches S1 to S6 in accordance with the detected thawing state signal, the switches S1 to S6 are switched in order to properly divide the supply voltage V1 through the resistances R10 to R15 and the resistance R8 and output the divided voltage as the bias or offset voltage applied to the inverting input terminal of the operational amplifier OP2. The above operation is conducted during or after the air refreshing cycle in the heating chamber 23.

When the thawing state detection signal outputted from the thawing state detection circuit 11 to the microcomputer 16 is initialized, the microcomputer 16 in the controller 21 controls the microwave output control circuit 20. In addition, the microwave output control circuit 20 controls the magnetron 22 and then the high frequency microwave energy is supplied into the heating chamber 23.

At this time, as the turntable rotates, the food 25 placed thereon is thawed by the high frequency microwave energy and then gas and moisture are generated in the heating chamber 23 as the food therein is thawed. The gas and moisture are exhausted by typical air refreshers to the outside of the microwave oven through the exhausting port 24 and the sensor 26 disposed at the exhausting port 24 detects the gas and moisture from the thawing food in the heating chamber 23.

Meanwhile, the thawing state detection circuit 11 includes a variable resistance Rs of the sensor 26, one end of which is connected to receive the power supply voltage V1 and the other end of which is in series with one end of a fixed resistance Rf, the other end of which is connected to a ground. Here, since the variable resistance Rs acts to vary its resistance value in accordance with the amount of gas and moisture which are exhausted from the exhausting port 24, the divided supply voltage V1 is obtained at point A between the variable resistance Rs and the fixed resistance Rf. Thereafter, the capacitor C which is connected to ground and in parallel with the fixed resistance Rf outputs the voltage at point A.

In the first amplifier 12, the sensor signal outputted from the thawing state detection circuit 11 is inputted to the non-inverting input terminal of the operational amplifier OP1. The resistance R3 is connected between the output terminal of the operational amplifier OP1 and the inverting input terminal thereof in parallel with resistance R2, and the other end of resistance R2 is connected to ground. The amplifying level is determined in accordance with the value of the resistances R2 and R3. Therefore, if the values of the resistances R2 and R3 are properly controlled, the level of the sensor signal voltage inputted to the first amplifier 12 is amplified to a predetermined level and is outputted to the rectifier 13.

In the rectifier 13, one end of a capacitor C1 and one end of a resistance R4 are commonly respectively connected to the output terminal of a diode D1 receiving the signals from the first amplifier 12 and the other ends of the capacitor C1 and the resistance R4 are commonly connected to ground. Here, the rectifier 13 rectifies the signal outputted from the first amplifier 12 and outputs the rectified DC signals to the second amplifier 14.

In the second amplifier 14, the output signal of the rectifier 13 is applied to the non-inverting input terminal of the operational amplifier OP2 through the resistance R5. The resistance R6 is connected between the non-inverting input terminal of the operational amplifier OP2 and the output terminal thereof. To the inverting input terminal of the operational amplifier OP2 is applied the bias voltage signal output of the bias voltage control circuit 15. Here, the signal outputted from the rectifier 13 and the voltage difference between the inverting and non-inverting inputs of the operational amplifier OP2 in accordance with the values of the resistances R5 and R6 is amplified up to a predetermined level and is outputted to the microcomputer through the resistance R7.

Figure 1:
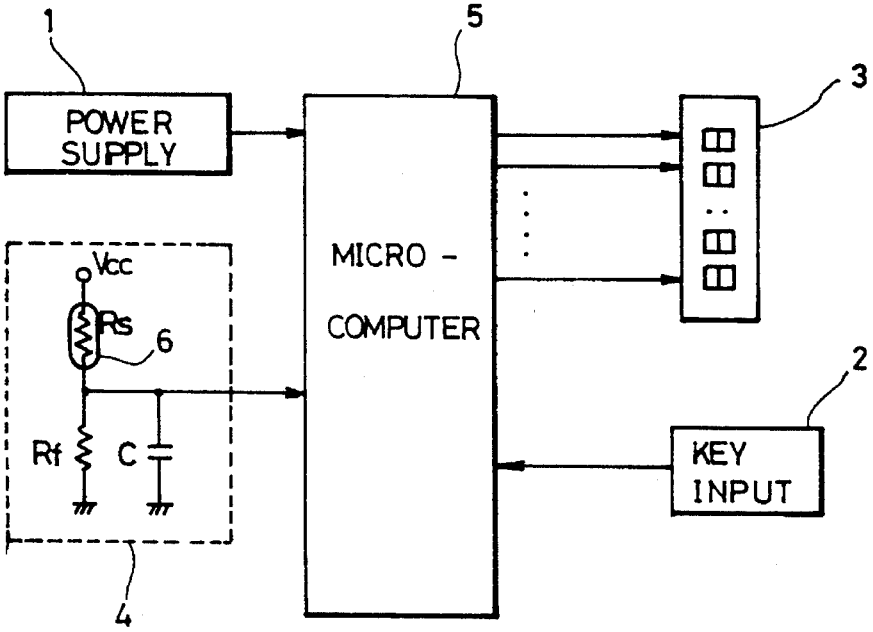
FIG. 1 CONVENTIONAL ART
FIG. 1 is a block diagram showing a structure of a conventional automatic thawing apparatus of a microwave oven.
Figure 2:
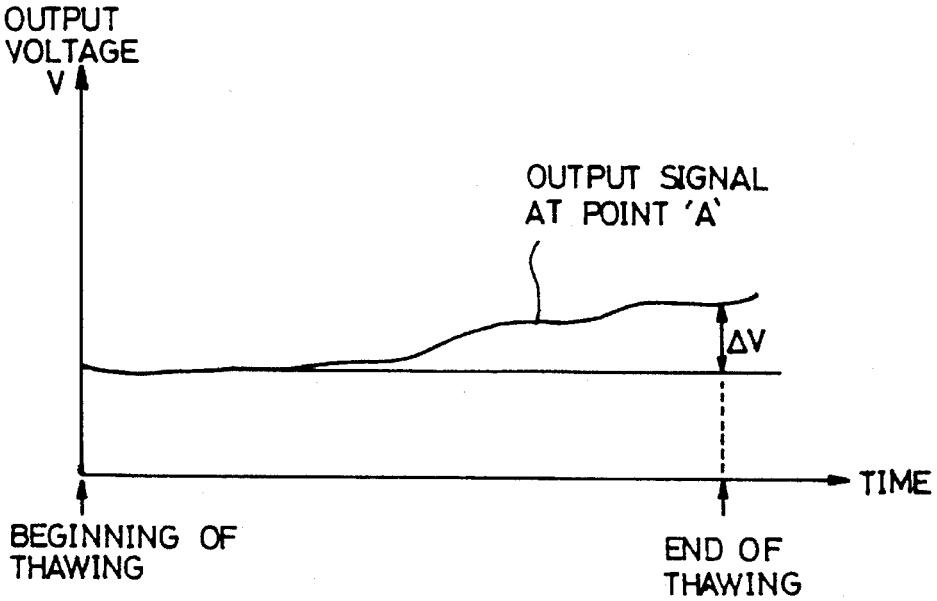
FIG. 2 CONVENTIONAL ART
FIG. 2 is a waveform graph showing the thawing state detection signal of a thawing state detection circuit of FIG. 1.
Figure 4:
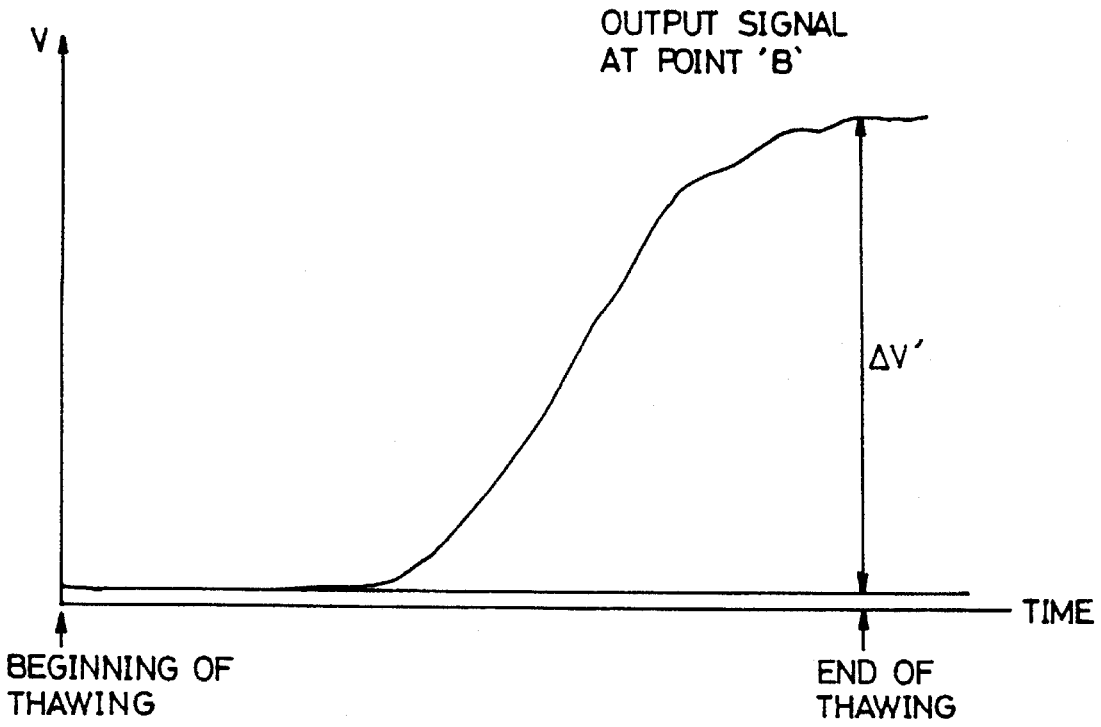
FIG. 4 is a waveform graph showing the output signals of a second amplifier circuit of FIG. 3.

The waveform of the output signal at point B of the second amplifier is shown in FIG. 4. As shown therein, the signal level difference Δv between the thawing state detection signal outputted to the microcomputer 16 at the initial stage of the thawing of the food 25 and the thawing state detection signal outputted to the microcomputer 16 at the end of the thawing operation of the food 25 significantly increases in comparison with the conventional art of FIG. 2. Therefore, the microcomputer can correctly and easily judge the thawing state of the food 25. That is, the microcomputer 16 judges the thawing state of the food 25 in accordance with the output signal of the second amplifier 14 and controls the output of the high frequency microwave energy and the thawing time by controlling the microwave output control circuit 20 in accordance with such judgement. In addition, the display circuit 18 displays the operation state and the operation time by means of the control of the microcomputer 16.

Figure 6:
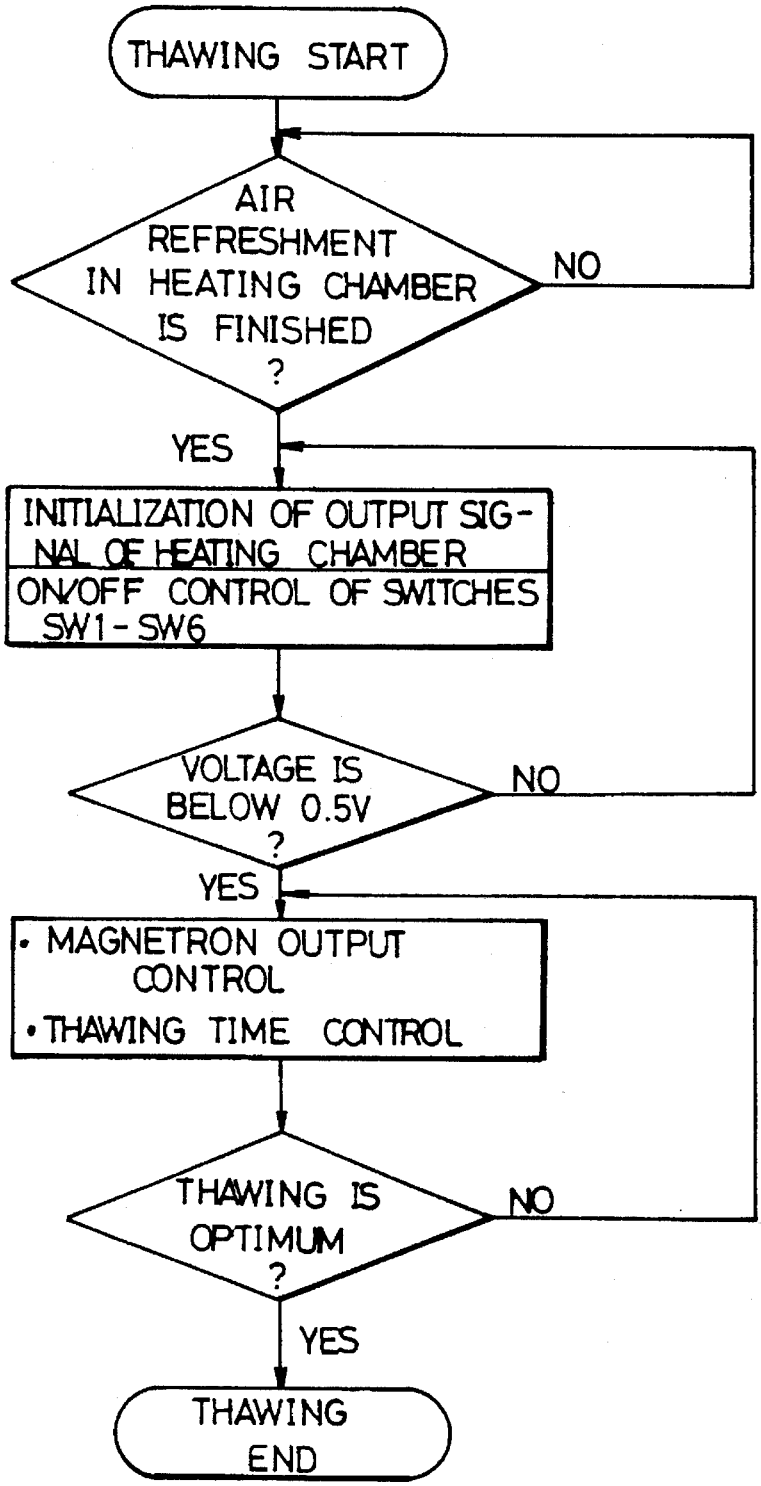
FIG. 6 is a flow chart showing an operation of an automatic thawing apparatus of a microwave oven according to the present invention.

Referring to FIG. 6, there is shown a flow chart of the thawing apparatus of the microwave oven according to the present invention. It shows the initialization of the thawing state detection signal inputted to the microcomputer 16 after the air refreshment cycle in the heating chamber 23. When the operation mode is automatic, the air refreshment operation in the heating chamber 23 is performed before the automatic thawing operation.

When the air refreshment operation in the heating chamber 23 is completed, the microcomputer 16 controls the on-off states of the switches SW1 to SW6 of the bias voltage control circuit 15 and initialize the voltage at point B as shown in FIG. 3 to be below 0.5 V. Thereafter, when the initialization is finished, the controller 21 starts to control the oscillation of the magnetron 22 and controls the amount of the high frequency microwave energy and the thawing time for properly thawing the food 25 in the heating chamber 23. As the thawing operation of the food 25 proceeds, the sensor 26 detects gas or moisture and outputs the resultant sensor signal to the controller 21. Here, the controller 21 judges the thawing state of the food 25. If the thawing state is judged as being optimum, the controller 21 terminates the thawing operation, and if the thawing state is judged as not being in an optimum state, the controller 21 controls the amount of the high frequency microwave energy and the thawing time for the optimum state of the food.

Accordingly, the present invention has the effects of properly and advantageously thawing the food by allowing the microcomputer to more accurately analyze the thawing state of the food by amplifying the thawing state detection signals which is of a low level and therefore difficult to detect at an initial stage of the thawing operation of the food to be increased to a predetermined level. In addition, the present invention initialize the thawing state detection signal to be at a predetermined level at an initial stage of the thawing of the food so that a more correct thawing operation can be secured.

What is claimed is:

1. An automatic thawing apparatus for a microwave oven having a heating chamber for placement of food therein, and microwave generating means for providing microwave energy in the heating chamber in order to heat the food therein in accordance with control signals applied thereto, the apparatus comprising:

thawing state detection means for generating a thawing state signal in accordance with the thawing state of the food;

at least one amplifying means electrically connected to said thawing state detection means for amplifying the thawing state signal generated by the thawing state detection means and producing an output signal;

bias voltage control means electrically connected to said amplifying means for generating a bias voltage signal for biasing the output signal of the amplifying means to a predetermined level at the beginning of a thawing operation; and control means electrically connected to said bias voltage control means for controlling the bias voltage control means, for initializing the output signal of the amplifying means to said predetermined level by controlling the bias voltage control means, for judging the thawing state of the food in the heating chamber in response to the signal outputted from the amplifying means, and for outputting the control signals in accordance with said judgement.

2. The apparatus of claim 1, further including: means for refreshing air in the heating chamber; and further wherein said control means controls the bias voltage control means in order to initialize the output signal of the amplifying means to said predetermined value while air in the heating chamber is refreshed by said means for refreshing.

3. The apparatus of claim 1, further including: means for refreshing air in the heating chamber; and further wherein said control means controls the bias voltage control means in order to initialize the output signal of the amplifying means to said predetermined value after air in the heating chamber is refreshed by said means for refreshing.

4. The apparatus of claim 1, wherein said bias voltage control means is for generating a plurality of bias voltage levels and for selectively applying said plurality of bias voltage levels to a bias voltage input of said amplifying means in accordance with a switching signal from said control means.

5. The apparatus of claim 1, wherein the output signal has an amplitude substantially proportional to the thawing state of the food.

6. The apparatus of claim 1, wherein the generated bias voltage signal remains unchanged while said microwave generating means provides the microwave energy in the heating chamber.

7. The apparatus of claim 1, wherein the predetermined level is less than 0.5 volts.

8. The apparatus of claim 1, wherein said control means controls said microwave generating means to provide the microwave energy only after the output signal is biased to the predetermined level.

9. A method for heating food in a food heating apparatus, comprising the steps of:

(a) detecting a temperature of the food and generating a signal in accordance with the detected temperature;

(b) amplifying the signal in an amplifier and producing an amplified signal;

(c) controlling a bias voltage of the amplifier such that the amplified signal is set to a predetermined level; and (d) activating a food heating element after the amplified signal has been set to the predetermined level.

10. The method of claim 9, wherein the amplified signal produced in said step (b) has an amplitude substantially proportional to the temperature of the food.

11. The method of claim 9, wherein said step (a) is initiated in response to a preceded step of:

(a0) refreshing air in a heating chamber of the food heating apparatus.

12. The method of claim 9, wherein the food heating element is inactive prior to said step (d).

* * * * *